US007798218B2

(12) United States Patent
Garstad et al.

(10) Patent No.: US 7,798,218 B2
(45) Date of Patent: Sep. 21, 2010

(54) APPARATUS AND A METHOD OF FRAGMENTING HARD PARTICLES

(75) Inventors: Johannes B. Garstad, Stathelle (NO); Helge Stridsklev, Stathelle (NO); Sven Egil Tjørhom, Sandnes (NO)

(73) Assignee: Environmental Technology AS, Sandnes (NO)

( * ) Notice: Subject to any disclaimer, the term of this patent is extended or adjusted under 35 U.S.C. 154(b) by 112 days.

(21) Appl. No.: 12/064,081

(22) PCT Filed: Aug. 24, 2006

(86) PCT No.: PCT/NO2006/000303

§ 371 (c)(1),
(2), (4) Date: May 2, 2008

(87) PCT Pub. No.: WO2007/024142

PCT Pub. Date: Mar. 1, 2007

(65) Prior Publication Data

US 2008/0230222 A1 Sep. 25, 2008

(30) Foreign Application Priority Data

Aug. 25, 2005 (NO) ..... 20053975

(51) Int. Cl.
*B01B 1/00* (2006.01)
*E21B 43/34* (2006.01)
*E21B 43/40* (2006.01)

(52) U.S. Cl. ..... 166/267; 166/75.12; 210/747; 405/129.2; 405/129.35

(58) Field of Classification Search ..... None
See application file for complete search history.

(56) References Cited

U.S. PATENT DOCUMENTS

| | | | | |
|---|---|---|---|---|
| 4,942,929 | A | 7/1990 | Malachosky | |
| 5,303,786 | A | 4/1994 | Prestridge et al. | |
| 5,310,285 | A | 5/1994 | Northcott | |
| 5,405,223 | A | 4/1995 | Sirevåg | |
| 5,947,396 | A | 9/1999 | Pierce | |
| 6,119,779 | A | 9/2000 | Gipson | |
| 6,321,860 | B1 | 11/2001 | Reddock | |
| 6,491,824 | B1 * | 12/2002 | Lin et al. | 210/666 |
| 6,527,054 | B1 | 3/2003 | Fincher et al. | |
| 6,923,871 | B2 * | 8/2005 | Walker et al. | 134/24 |
| 2003/0106713 | A1 * | 6/2003 | Slater et al. | 175/5 |
| 2003/0164235 | A1 * | 9/2003 | Leeson et al. | 166/266 |
| 2004/0112822 | A1 * | 6/2004 | Saik | 210/241 |

FOREIGN PATENT DOCUMENTS

| | | |
|---|---|---|
| WO | 9320328 | 10/1993 |

* cited by examiner

*Primary Examiner*—George Suchfield
(74) *Attorney, Agent, or Firm*—Christian Abel

(57) ABSTRACT

A method of treating particulate hard materials driven to the surface of a well in a returning well flow in connection with a producing well or well stimulation operations in the petroleum production industry, the method including fragmentation of the hard particles by means of a crushing device, whereupon the fragmented hard particles are turned into a slurry which is then re-injected into an injection well.

10 Claims, 3 Drawing Sheets

APPARATUS AND A METHOD OF FRAGMENTING HARD PARTICLES

Figure 1:
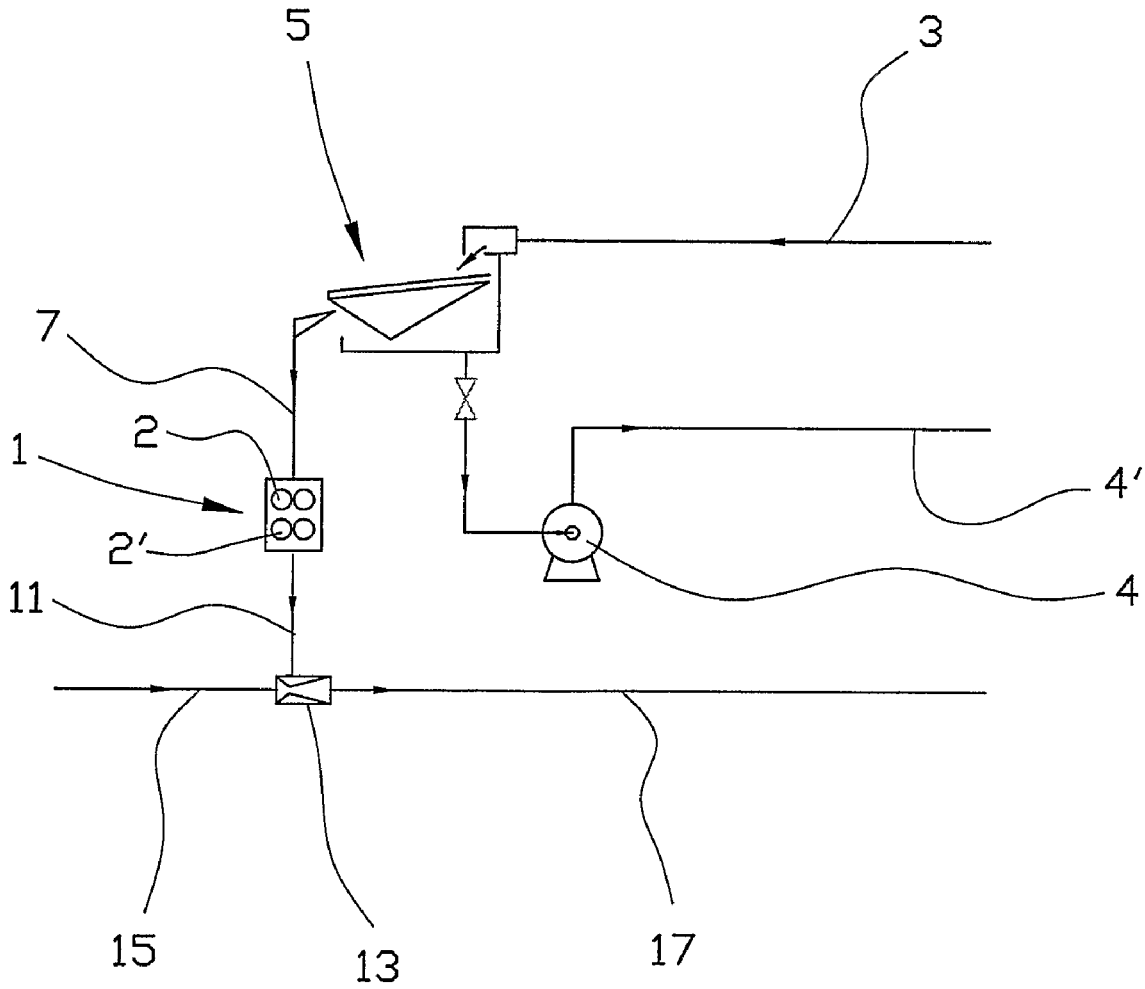

The present invention regards a method of treating hard particles in a returning well stream prior to re-injection of particle slurry into an injection well in connection with petroleum production. More particularly it regards fragmentation of so-called proppants, which, among other things, are used in connection with well stimulation operations, to ensure that the fragmented proppants will not cause blockage of the injection well.

The term proppant, as used herein, means small, preferably spherical and extremely hard particles made from a material such as, but not limited to, sintered bauxite.

The object of the invention is to provide a method for use when fragmenting proppants that have been carried up to the rig in a returning well flow prior to re-injection of a particle slurry in an injection well, so as to allow fragmented proppants to be injected into a disposal well with other waste products instead of being transported to an onshore disposal site.

A number of methods are known for crushing particles carried to the surface by e.g. a drilling rig in connection with drilling of wells.

Norwegian patents NO 316 937 and NO 175 412 and American patents U.S. Pat. No. 5,303,786 and U.S. Pat. No. 4,942,929 describe various methods and means of treating drill cuttings, in order to reduce the size of the drill cuttings and so allow them to be injected or pumped in the form of a dispersion or emulsion, into subterranean formations such as so-called disposal wells.

Although at least some of the above prior art has proven to be effective in the treatment of drill cuttings and re-injection of this, the challenge related to the treatment of proppants for re-injection is not solved by the methods and the means described in the above or other patent publications. For that reason, hard particles such as proppants in a returning well stream are collected on the drilling rig and brought to shore for disposal. In this connection it should be mentioned that there have been several attempts to re-inject proppants into disposal wells. However, the risk of blocking pipes, pumps and injection wells has proved too great, and so practically all proppants brought to the surface in a returning well flow are separated out and transported to shore for disposal as mentioned above.

The object of the invention is to remedy or at least reduce one or more drawbacks of prior art.

The object is achieved through features stated in the description below and in the following claims.

In one aspect, the present invention provides a method of treating hard particulate materials driven to the surface of a well in a returning well flow in connection with a producing well or well stimulation operations in the petroleum production industry, where the method includes fragmentation of the hard particles by a crushing device, whereupon the fragmented hard particles are subjected to slurrification and then re-injected into an injection well.

In a preferred embodiment the hard particles are separated from the fluid in the returning well flow before the hard particles are fragmented in a crushing device. This separation of solids and fluid is carried out by use of one or more separating devices that are known per se, such as, but not limited to, vibratory separator(s), so-called shale shaker(s), and/or hydro cyclone(s).

In a preferred embodiment the crushing device is constituted by a so-called crushing mill equipped with rollers that have been specially adapted to crush hard particles such as proppants. As it is important that essentially all the hard particles are crushed before being mixed with a liquid, e.g. by use of a venturi, in order to form a particle slurry, the crusher may include one or more sets of rollers arranged e.g. over each other. The use of several sets of crushing mills would be particularly relevant in the case of varying particle sizes. However, a person skilled in the art will know that at least artificial proppants are generally of a relatively uniform size, making it possible to achieve practically 100% crushing of the material with only one set off rollers.

Figure 2:
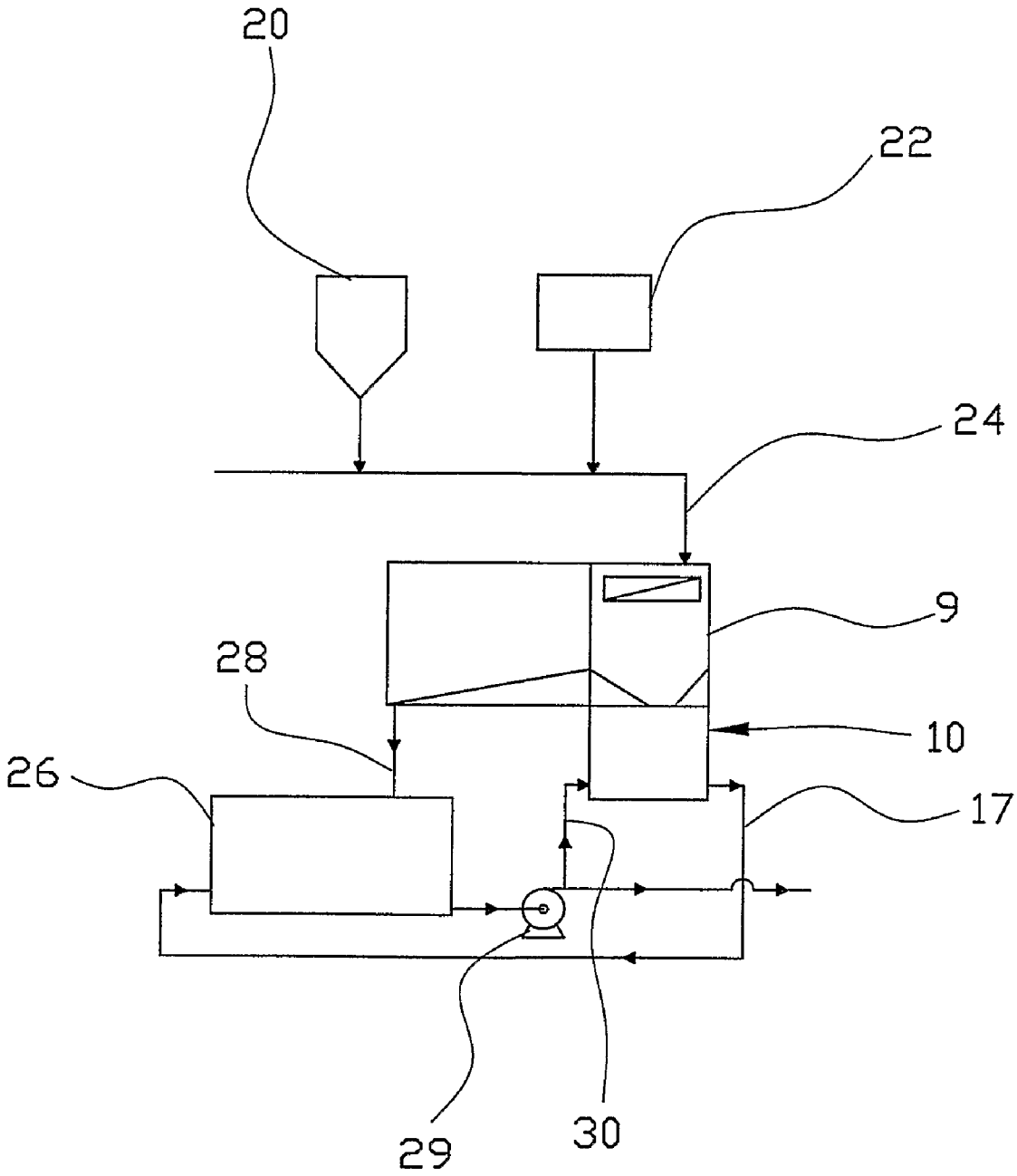
Figure 3:
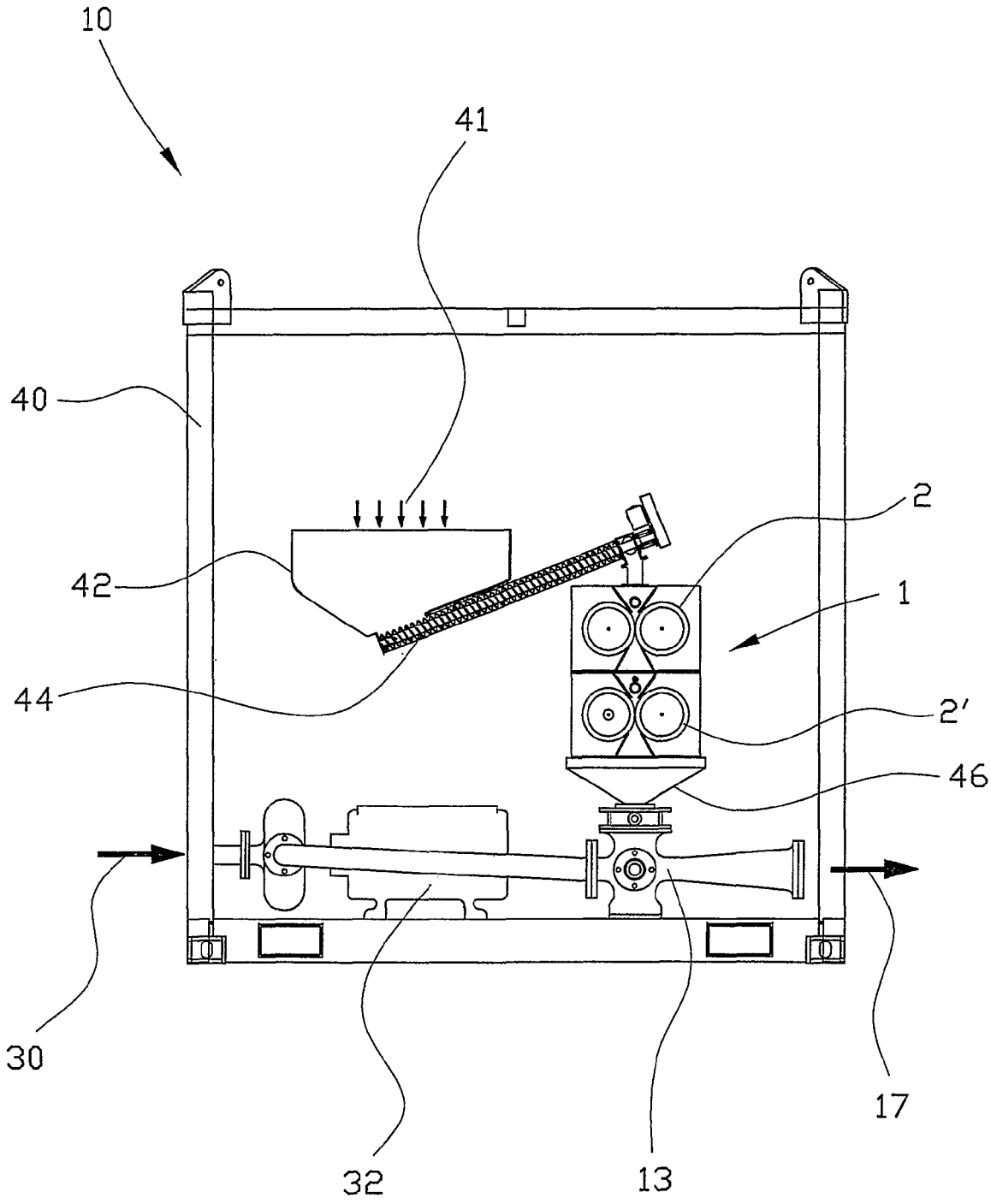

The following describes a non-limiting example of a preferred embodiment illustrated in the accompanying drawings, in which the same or similar components are indicated by the same reference number, and in which:

FIG. 1 is a schematic diagram showing part of a process plant for crushing hard particles, where a returning well flow is passed across a vibratory screen to separate the liquid phase from the solids, which are then passed through a crushing mill assembly, whereupon the crushed solids are mixed with a fluid in a venturi, thus providing a particle slurry suitable for re-injection into an injection well;

FIG. 2 is a schematic diagram of a crushing unit that forms part of a separate cleaning unit in an existing treatment unit for clean-up of a returning well flow; and FIG. 3 is a simplified view of the cleaning unit in FIG. 2 on a greater scale.

In the figures, reference numeral 1 denotes a crushing device constituted by a crushing mill specially designed to crush so-called proppants which are brought to a well surface in a returning well flow in connection with production and well stimulation in the petroleum industry. A person skilled in the art will appreciate that the device is also suited for crushing other particles besides proppants, and that the device may also be of use in other areas than the petroleum industry.

In FIG. 1, a returning well stream is brought via a line 3 into a sieving apparatus 5 of a type that is known per se, and where the sieving apparatus 5 is arranged to separate solids such as proppants from a liquid phase in a returning well flow. The sieving apparatus 5 may include one or more sieving cloths. The use of several sieving cloths will allow sieving of solids according to size, in a manner that is known per se. Doing this will make it possible to separate solid particles that exceed a predetermined size defined according to the setting of the crushing mill 1, and then route these to other treatment plants (not shown) that are known per se, for further treatment.

After the solids have been separated from the liquid phase, the solids are conveyed via a line 7 to the crushing mill 1. Liquid separated from the returning well flow in the sieving apparatus 5 is pumped out by a pump 4 and carried away by a line 4'. In the crushing mill 1, proppants are fragmented or crushed to a predetermined particle size. FIG. 1 suggests two pairs of rollers 2, 2', with one pair arranged over the other. It should be appreciated that the rollers of each pair are preferably arranged in parallel, so that the clearance between the rollers is essentially constant along the longitudinal extent of the rollers. The clearance between the rollers may be the same for both pairs of rollers, but in a preferred embodiment it is arranged so that the upper pair 2 of rollers has a greater clearance than that of the lower 2' pair of rollers. Thus in such an assembly the size of the fragmented proppants will be determined by the clearance of the lower pair 2' of rollers, which is the smaller of the two.

Fragmented proppants are conveyed via a line 11 from the crushing mill 1 to a venturi 13. Liquid is also passed through the venturi 13, which liquid is introduced into the venturi 13 via line 15. This produces particle slurry of fragmented proppants, which particle slurry is conveyed via a line 17 and on to a collecting receptacle (not shown). From the collecting receptacle the particle slurry is injected into an injection well (not shown) in a manner that is known per se.

FIG. 2 shows an exemplary embodiment of how the process system shown in FIG. 1 can be integrated into an existing process system as a separate fragmentation and slurrification unit 10. After going through cleaning processes in a desander 20 and a hydro cyclone 22, fluid and solids, e.g., but not limited to, proppants, are directed into separate compartments of an intermediate storage tank 9 via lines 24 (only one shown). The liquid is sent out of the intermediate storage tank 9 and into a disposal and mixing tank 26 via a line 28. Proppants are brought from the solids compartment of the intermediate storage tank 9 to a fragmentation and slurrification unit 10, in which proppants are fragmented and mixed with fluid. The fluid is introduced into the fragmentation and slurrification unit 10 via a pump 29 and a feed line 30. A person skilled in the art will know that cleaning devices other than said desander 20 and hydro cyclone 22 may be used to separate the liquid phase of the well fluid from the solids of the well fluid.

FIG. 3 shows, on a greater scale, a schematic view of the fragmentation and slurrification unit 10. The fragmentation and slurrification unit 10 is shown arranged inside a freight container 40 of a type that is known per se, to allow it to be transported as one unit. Solids such as proppants are fed from the intermediate storage tank 9 (see FIG. 2) to an equalizing reservoir 42. In FIG. 3 this is indicated by arrows 41. Proppants are delivered to the crushing mill 1 from the equalizing reservoir 42 via a feed screw 44. However, it will be appreciated that proppants may equally well be delivered directly from e.g. the intermediate storage tank 9 without using the equalizing reservoir 42. The feed screw is arranged in a manner that is known per se to provide the desired proppant feed rate into the crushing mill 1. Fragmented proppants are conveyed via a funnel body 46 into the venturi 13, and fluid from the feed line 30 (see FIG. 2) is pumped into the venturi 13 by use of pump 32, thus forming slurry with fragmented proppants. The slurry is then carried out of the fragmentation and slurrification unit 10 via a line 17, which in FIG. 3 is indicated by an arrow. In the embodiment of FIG. 2, the slurrified fluid is returned to the disposal and mixing tank 26 prior to being sent on to further slurrification in the fragmentation and slurrification unit 10 or to intermediate storage in a tank (not shown), prior to being injected into an injection well in a manner that is known per se. The method illustrated in FIG. 2 will provide full control over the ratio between fragmented particles and liquid in the slurry.

Thus the method of the present invention solves the challenges posed by the problem waste of proppants, which up till now has required disposal on shore. In situ tests have shown that the problem of blocked pipes, pumps and injection wells are avoided by using the method of the present invention.

The invention claimed is:

1. A method of treating proppants in a returning well stream flow for use in well stimulation operations, comprising first separating proppants from the well stream flow and further comprising the following steps:

a. fragmenting proppants to a predetermined particle size;

b. mixing fragmented proppants with a fluid in a venturi in order to form a particle slurry having a higher degree of fineness than said returning well stream flow; and c. injecting the particle slurry into a well.

2. The method of claim 1, wherein the fluid in step b) comprises the well stream flow.

3. The method of claim 1, wherein other solids are separated from the well stream flow prior to step a).

4. The method of claim 1, wherein step a) comprises the feeding of proppants through two successive crushing devices (2, 2'), wherein the first crushing device comprises a greater clearance than the second crushing device.

5. The method of claim 1, wherein the fluid in step b) comprises the particle slurry, and that fragmented proppants in step b) are mixed with previously produced particle slurry, whereby the ratio between fragmented particles and liquid in the slurry may be controlled.

6. An apparatus for treating proppants in a returning well stream flow for use in well stimulation operations, comprising a sieving apparatus (5) for separating proppants from a liquid phase in the returning well stream flow, a line (7) for transporting proppants from the sieving apparatus to a fragmentation and slurrification unit (10), said fragmentation and slurrification unit (10) comprising at least one crushing device (2, 2') for fragmenting said proppants to a predetermined particle size, connected to a venturi (13) at an upstream end being connected to a fluid source via a feed line (30) and at a downstream end being connected to a line (17) for transporting a slurry comprising said proppants particles and fluid from said fluid source.

7. The apparatus of claim 6, wherein the crushing device (2, 2') comprises two successive crushing devices, wherein the first crushing device (2) comprises a greater clearance than the second crushing device (2').

8. The apparatus of claim 6, wherein the crushing device comprises a crushing mill (2, 2') comprising rollers specially adapted to crush hard particles.

9. The apparatus of claim 6, wherein the fragmentation and slurrification unit (10) further comprises an equalizing reservoir (42) for receiving proppants, and a feed screw (44) for transporting proppants from the equalizing reservoir and into the crushing device.

10. The apparatus of any one of claims 6-9, wherein the fragmentation and slurrification unit (10) is adapted for placement inside a freight container (40) of a known type.

* * * * *